United States Patent [19]

Aoyama et al.

[11] Patent Number: 4,710,135

[45] Date of Patent: Dec. 1, 1987

[54] ELECTRICAL CONNECTOR HAVING INTEGRAL LATCH MEANS

[75] Inventors: Kohji Aoyama, Tokyo; Masaro Noguchi, Sagamihara, both of Japan

[73] Assignee: AMP Incorporated, Harrisburg, Pa.

[21] Appl. No.: 884,157

[22] Filed: Jul. 10, 1986

[51] Int. Cl.[4] ..... H01R 13/639

[52] U.S. Cl. ..... 439/354; 439/598

[58] Field of Search ..... 339/91 R, 59 R, 59 M

[56] References Cited

U.S. PATENT DOCUMENTS

| | | | |
|---|---|---|---|
| 3,192,499 | 6/1965 | West | 339/91 R |
| 3,530,424 | 9/1970 | Gregory | 339/59 M |
| 3,693,134 | 9/1972 | Trevisiol | 339/91 R |
| 3,781,760 | 12/1973 | Mancini et al. | 339/59 M |
| 3,829,821 | 8/1974 | Derr et al. | 339/31 |
| 3,944,312 | 3/1976 | Koenig | 339/59 R |
| 4,089,579 | 5/1978 | Steinbach | 339/91 |
| 4,214,802 | 7/1980 | Otani et al. | 339/91 R |
| 4,571,017 | 2/1986 | Fujita | 339/59 |

FOREIGN PATENT DOCUMENTS

| | | | |
|---|---|---|---|
| 0119031 | 9/1984 | European Pat. Off. . | |
| WO84/03803 | 9/1984 | PCT Int'l Appl. . | |
| WO85/05501 | 12/1985 | PCT Int'l Appl. | 339/91 R |
| 992892 | 5/1965 | United Kingdom . | |
| 1535069 | 12/1978 | United Kingdom . | |
| 2018048 | 10/1979 | United Kingdom | 339/91 R |
| 1571544 | 7/1980 | United Kingdom . | |
| 2061633 | 5/1981 | United Kingdom . | |

*Primary Examiner*—John McQuade

*Attorney, Agent, or Firm*—Bruce J. Wolstoncroft

[57] ABSTRACT

An electrical connector (30) comprises a plug housing (20) and a receptacle housing (10) which are mated and secured together. The securing members, latching arm (23) of plug housing (20), and engaging portion (12) of receptacle housing (10) form a portion of an upper surface of each of the housings which allows the overall size of the electrical connector (30) to be reduced.

14 Claims, 5 Drawing Figures

1A
1B
2
2A
2B
3
10
11
12
12a
12b
13
20
21
22
22a
23
23a
24
24a
25
30
A
B

FIG. 4
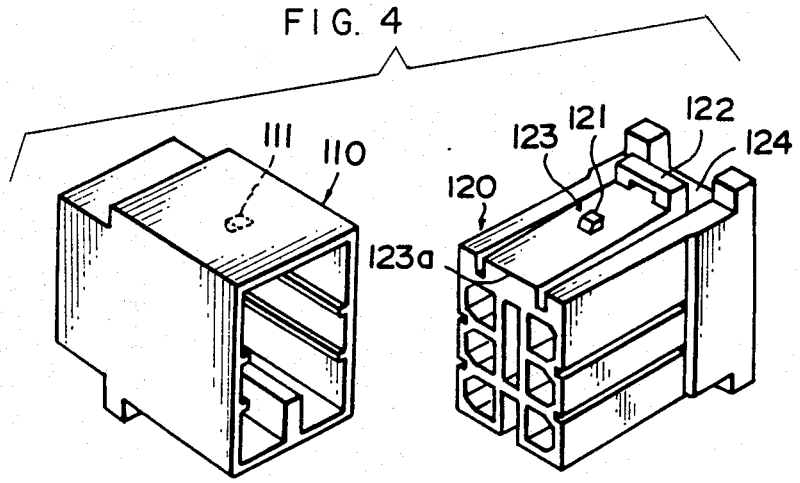
PRIOR ART
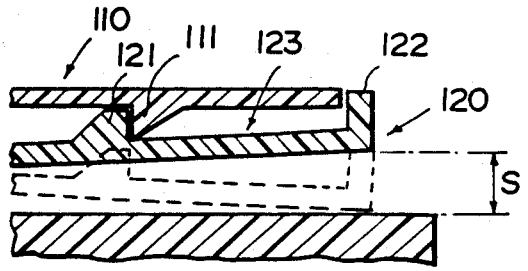
FIG. 5
PRIOR ART

ELECTRICAL CONNECTOR HAVING INTEGRAL LATCH MEANS

FIELD OF THE INVENTION

This invention relates to an electrical connector comprising a receptacle housing and a plug housing, each retaining a number of electrical contacts therein, and in particular to an improvement of the structure of both housings that enables the size of the connector to be reduced.

BACKGROUND OF THE INVENTION

Prior art connectors having a matable receptacle housing and plug housing and containing matable electrical contacts respectively are widely used in practice. These connectors include latching members which firmly maintain both housings in engagement and also allow the housings to be released. Referring to FIGS. 4 and 5, a description of an existing connector provided with such a latching arrangement is as follows.

The receptacle housing 110 and plug housing 120 respectively each retain, for example, electrical contacts (not shown) and the housings are constructed to mate with each other by plug housing 120 being matable with housing 110. The upper surface of plug housing 120 includes an integral latching arm 123 fixed thereto at a front end portion 123*a*, in the direction of mating with housing 110. Latching arm 123 includes an engaging projection 121 at a center portion thereof and a pressure projection 122 at a rear end thereof. An inside wall of housing 110 has a projection 111 which engages with engaging projection 121 when plug housing 120 is in the mated position. When both housings are being mated, latching arm 123 is bent as plug housing 110 is inserted into housing 120, and therefore, engaging projection 121 of latching arm 123 and projection 111 are engaged and maintain both housings in the mated condition as illustrated in FIG. 5. When both housings are to be unmated, the housings are unlatched from each other by pressing on pressure projection 122 to bend latching arm 123 to the position shown by the dotted line in FIG. 5, thus releasing the engagement of engaging projection 121 of latching arm 123 from projection 111 of housing 110 whereby the housings can be separated.

However, in the connector having the aforesaid structure, the height of the plug housing is made larger creating a problem in that the entire connector has increased height. Moreover, as explained above, when releasing the mating of both housings, the disengagement of engaging projection 121 from projection 111 takes place by pressing pressure projection 122, and as pressure projection 122 is situated farther than engaging projection 121 from the forward end of the latching arm, which is the fulcrum, pressure projection 122 must be moved by as much as the distance S to bring it to a position even lower than engaging projection 121 in order to shift the engaging projection downward to the position where the engagement with projection 111 is released. Accordingly, it is necessary to provide a space in the plug housing between the pressure projection and the upper surface wall of the housing higher than the distance S to allow for the downward movement of the pressure projection, and therefore a disadvantage occurs in that the housing, and thus the entire connector, must be made to have a greater height.

SUMMARY OF THE INVENTION

In consideration of the aforesaid problems, an object of the present invention is to provide a connector that firmly retains the matable plug housing in the receptacle housing in a manner which allows for the release of the matable housings. The plug housing is designed so as to reduce the size of the connector.

The electrical connector of this invention comprises a receptacle housing and a plug housing. The plug housing has a forward latching member and a rear latching member with an aperture therebetween forming an upper wall of the plug housing. The forward latching member is pivotally secured at its front end to the side walls of the plug housing and the rear latching member has a rear section secured to the side walls. The rear section of the forward latching member and the forward section of the rear latching member are in spaced overlapping relationship at the aperture enabling the latching members to operate without interfering with each other.

BRIEF DESCRIPTION OF THE DRAWINGS

In the following there will be described by way of example a preferred embodiment of the present invention with reference to the drawings, in which:

FIG. 4 is a perspective view of housings of a connector according to the prior art; and FIG. 5 is a fragmentary cross-sectional view of the prior art showing the movement of a latching arm.

DETAILED DESCRIPTION OF THE INVENTION

Figures 1, 2, 3:
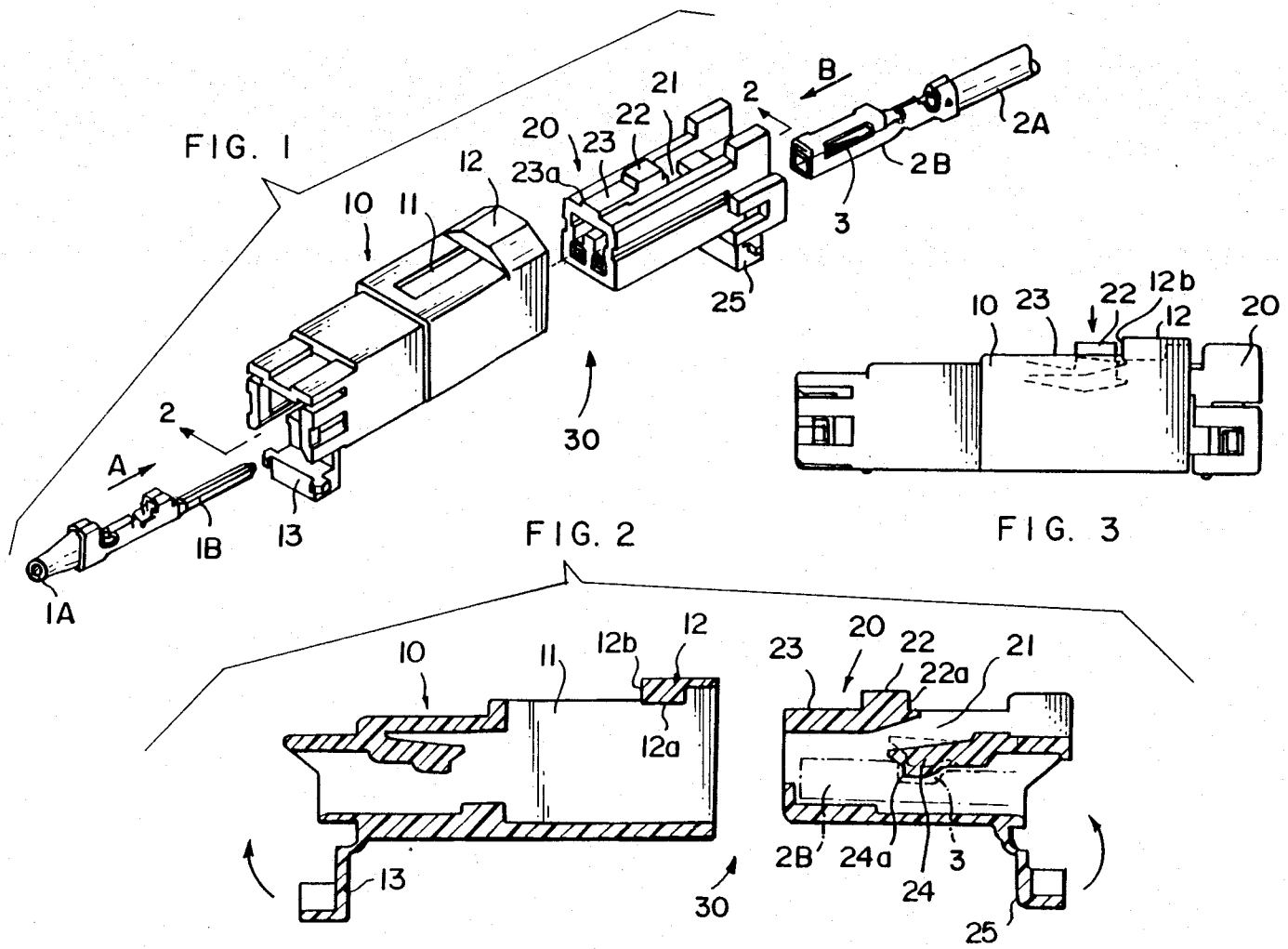
FIG. 1 is an exploded perspective view of the connector according to the present invention.
FIG. 2 is a simplified cross-sectional view of the housings of the connector taken along line 2—2 of FIG. 1.
FIG. 3 is a lateral view of the housings in the mated position, having dotted lines indicating the movement of a latching arm.

Connector 30, as shown in FIG. 1, is comprised of a receptacle housing 10 and a plug housing 20. Male contact portion 1B, attached to a forward end of a wire 1A, is inserted into housing 10 in the direction of arrow A and retained therein. Corresponding female contact portions 2B, attached to a forward end of a wire 2A, is inserted in housing 20 in the direction of an arrow B. It should be noted that although connector 30, with a single terminal therein, is shown, any number of terminals may be inserted into corresponding housings. Hinged holder members 13, 25 are respectively arranged on both housings. Members 13, 25 turn in the direction shown by the arrows in FIG. 2 to extend across an end of the housing, doubly securing contacts 1B, 2B in their respective housings. As explained, both housings 10, 20 retain contacts 1B, 2B internally, to be mated as one unified body by mating housing 20 inside housing 10. The following is an explanation of the mating of the housings.

An aperture 21 is provided on an upper surface of housing 20. A forward latching member in the form of a resilient latching arm 23, having resilient characteristics, is fitted between the side walls of housing 20. A forward end 23*a* of latching arm 23 is pivotally mounted to the sidewalls of housing 20 such that latching arm 23 may move in the direction shown in FIG. 3. An engaging projection 22 is positioned on a top surface of a rear end of latching arm 23.

An aperture 11 is located in an upper surface of housing 10. Adjacent aperture 11 is an engaging portion 12. In this embodiment, engaging portion 12 has a stepped portion 12*a* projecting downward, the entire portion 12 being positioned above housing 10.

When housing 20 is inserted into housing 10, projection 22 of latching arm 23 engages portion 12*a* of portion 12. This engagement causes arm 23 to be moved inwardly. A rear latching member in the form of a resilient lance 24 is provided in housing 20 to prevent arm 23 from being moved inwardly too far, eliminating the possibility of arm 23 taking a permanent set. Lance 24 has a rear section secured to the sidewalls of housing 20 and has an engaging section 24*a* which extends into slot 3 of electrical contact 2B to secure contact 2B in housing 20. Member 25, when in a closed position, engages a rear section of contact 2B thereby forming a second securing member to make certain contact 2B is secured in housing 20. As contact 2B is inserted into housing 20, the bottom of lance 24 engages contact 2B, forcing lance 24 upward, and when contact 2B is properly positioned in housing 20, lance 24 moves downwardly with engaging section 24*a* extending into slot 3 of contact 2B thereby forming a first securing member securing contact 2B in housing 20.

Projection 22 of latching arm 23 moves inwardly as housing 20 is inserted into housing 10. As insertion continues, projection 22 moves past portion 12 allowing the resilient characteristics of arm 23 to position projection 22 in the position shown in FIG. 3. A rear surface 22*a* of engaging projection 22 engages an inner surface 12b of portion 12, latching housings 10, 20 together and preventing housings 10, 20 from unwanted disengagement.

Thus, the connector of this invention may be designed such that the height of housings 12, 20 are reduced because aperture 11 and arm 23 are positioned to form part of the upper surface of the respective housings. Latching arm 23 and lance 24 form the upper wall of housing 20; their inner ends are spaced from each other but they overlap forming an aperture therebetween. Latching arm 23 is spaced outwardly from lance 24 and they are substantially parallel to one another.

FIG. 3 shows connector 30 in the mated position. When releasing housings 10, 20 from this position, projection 22 is forced downward. This causes latching arm 23 to bend to the position in which projection 22 is released from engagement with portion 12, as shown by the dotted lines in FIG. 3, allowing easy disengagement of housing 20 from housing 10.

The design of latching arm 23 requires minimal space for operation. Projection 22 acts as both the engaging projection as well as the release projection. This configuration requires less space for operation than previous housings. The engaging projection is situated at the lowermost position when releasing the engaging projection from the latched position, unlike previous housings in which the release projection was situated farther to the rear of the engagement projection causing the arm to be longer, requiring more space for disengagement. For this reason, the height of housings 10, 20 of the present invention can be reduced.

The shape of arm 23 and portion 12 are not limited to those illustrated. For example, the faces of the engaging projection and the inside wall of the engaging portion can be tapered in order to attain a smooth mating of the housings. Moreover, it is not always necessary that the engaging portion be projected upward.

Thus, an electrical connector has been disclosed which comprises matable housing members with one of the housing members having a connector latching member and a terminal latching member forming an upper surface of the housing member thereby reducing the height of the connector.

What is claimed is:

1. An electrical connector comprising a dielectric matable receptacle housing and a dielectric matable plug housing, the receptacle housing having a plurality of terminals therein, the plug housing having a like plurality of matable terminals located therein, the electrical connector being characterized in that:

a resilient latching arm is located between sidewalls of the plug housing forming part of an upper wall of the plug housing, the latching arm having a front portion which is pivotally connected to the sidewalls of the plug housing and a rear portion which has an engaging projection located therein, a lance is provided in the plug housing rearwardly of the latching arm forming another part of the upper wall of the plug housing, inner ends of the resilient latching arm and the lance are spaced from each other in overlapping relationship, forming an aperture therebetween, an engaging portion is provided on the receptacle portion, the engaging portion positioned to cooperate with the latching arm, whereby as the receptacle housing and the plug housing are mated together, the latching arm of the plug housing comes in contact with the engaging portion of the receptacle housing, such that as mating continues, the engaging projection of the latching arm engages the engaging portion, causing the latching arm to move inwardly, and as mating is completed, the projection moves past the portion, allowing the latching arm to resiliently return to its unstressed position, thereby placing the projection in an aperture of the receptacle housing in contact with the portion, latching the housings together and preventing the housings from unwanted disengagement.

2. An electrical connector as recited in claim 1 characterized in that the engaging portion projects downward and has a stepped surface.

3. An electrical connector as recited in claim 2 characterized in that the engaging projection extends upward to cooperate with the stepped surface of the engaging portion.

4. An electrical connector as recited in claim 1 characterized in that the lance is positioned adjacent a terminal receiving cavity such that as a terminal is inserted, a projection of the lance engages the terminal, forcing the lance upward.

5. An electrical connector as recited in claim 1 characterized in that the engaging projection may be forced downward to allow the housings to be disengaged from each other.

6. An electrical connector as recited in claim 1, characterized in that the latching arm and the lance are substantially parallel.

7. An electrical connector as recited in claim 1, characterized in that the inner end of the latching arm can engage the inner end of the lance limiting the inward movement of the latching arm.

8. An electrical connector comprising:

a first matable dielectric housing and a second matable dielectric housing, the first housing having a plurality of terminals positioned therein, the second housing having a like plurality of matable terminals positioned therein;

a resilient latching arm located between sidewalls of the first housing and forming part of an upper wall of the first housing, a front portion of the latching arm being pivotally mounted to the sidewalls of the first housing, a rear portion of the latching arm having an engaging projection;

a lance positioned proximate the latching arm in the first housing and forming another part of the upper wall of the first housing;

spaced apart inner ends of the resilient latching arm and the lance, the inner ends spaced in an overlapping relationship, thereby forming an aperture therebetween; and an engaging portion located on an upper surface of the second housing adjacent an aperture on the upper surface of the second housing such that as the housings are mated together, the latching arm is displaced by the engaging portion causing the latching arm to move inwardly, and as mating is completed, the engaging projection moves past the engaging portion allowing the latching arm to return to an unstressed position such that the engaging projection and engaging portion cooperate to latchably secure the first and second housings together.

9. an electrical connector as recited in claim 8 wherein the engaging portion projects downward and has a stepped surface.

10. An electrical connector as recited in claim 9 wherein the engaging projection extends upward to cooperate with the stepped surface of the engaging portion.

11. An electrical connector as recited in claim 8 wherein the lance is positioned adjacent a terminal receiving cavity such that as a terminal is inserted, the lance engages the terminal, forcing the lance upward.

12. An electrical connector as recited in claim 8 wherein the engaging projectin may be forced downward to allow the housings to be disengaged from each other.

13. An electrical connector as recited in claim 8, wherein the latching arm and the lance are substantially parallel.

14. An electrical connector as recited in claim 8, wherein the inner end of the latching arm can engage the inner end of the lance limiting the inward movement of the latching arm.

* * * * *